US006884167B2

(12) United States Patent
Walker et al.

(10) Patent No.: US 6,884,167 B2
(45) Date of Patent: Apr. 26, 2005

(54) ELECTRONIC GAMING DEVICE OFFERING A GAME OF KNOWLEDGE FOR ENHANCED PAYOUTS

(75) Inventors: Jay S. Walker, Ridgefield, CT (US); James A. Jorasch, Stamford, CT (US); Thomas M. Sparico, New York, NY (US)

(73) Assignee: Walker Digital, LLC, Stamford, CT (US)

( * ) Notice: Subject to any disclaimer, the term of this patent is extended or adjusted under 35 U.S.C. 154(b) by 382 days.

(21) Appl. No.: 10/023,149

(22) Filed: Dec. 18, 2001

(65) Prior Publication Data

US 2002/0155879 A1 Oct. 24, 2002

(Under 37 CFR 1.47)

Related U.S. Application Data

(63) Continuation-in-part of application No. 09/713,046, filed on Nov. 15, 2000, now Pat. No. 6,331,144, which is a continuation of application No. 08/885,157, filed on Jun. 30, 1997, now Pat. No. 6,193,606.

(51) Int. Cl.[7] ..... A63F 13/00
(52) U.S. Cl. ..... 463/20; 463/16; 463/9
(58) Field of Search ..... 463/9, 16, 20, 463/42

(56) References Cited

U.S. PATENT DOCUMENTS

| | | | |
|---|---|---|---|
| 3,825,265 A | 7/1974 | Pitkanen et al. | 273/126 R |
| 4,030,555 A | 6/1977 | Boyce et al. | 273/110 |
| 4,354,680 A | 10/1982 | Kmiec | 273/121 A |
| 4,363,485 A | 12/1982 | Edwall | 273/121 A |

FOREIGN PATENT DOCUMENTS

GB 2 167 676 A 6/1986

OTHER PUBLICATIONS

"Atari", Byte, May, 1983, Section: Nucleus, Software Received at p. 509.
Borden, Jeff, "WMS Betting That Grown–ups Want to Play; Kids Game Maker Hopes Slots Will Boost Its Stock", Crain's Chicago Business, May 20, 1996, (News) at p. 3.
Buckley, Taylor J., "The Quest For Gambling's 'Holy Grail', Industry Seeks Next–Generation Slot Machine", USA Today; May 20, 1996, (News) at p. 1A.
PR Newswire, Business Desk, Status Game Corp., Newington, Conn., Mar. 12, 1996.
Grochowski, John "Empress III has power of predecessors", Chicago Sun–Times, Jul. 7, 1996, Section: SHO, Casinos, at p. 13.
Gebeloff, Rober "His AOL Game is a Winner; Real Escape Man", The Record; Jan. 7, 1997, Section: News, at p. L01.
"Casino Data Systems Introduces Reel Deal™ Video Poker Series; Increased Player Entertainment With On–Screen Video Reel", PR Newswire, Apr. 23, 1997, (http //biz yahoo com/prnews).
Website: "Slots of Trivia Win 95 at Rocket Download", Slots of Trivia Win 95, (wysiwyg//109/http //199 217 92 26/Details/Chan/trivia95 htm), download date Sep. 17, 1999.

(Continued)

*Primary Examiner*—John M. Hotaling, II
(74) *Attorney, Agent, or Firm*—Michael D. Downs

(57) ABSTRACT

One embodiment of the present invention provides for receiving an indication of a wager, displaying a set of spinning reels, receiving a response to a game of knowledge while the reels are spinning, determining a score based on the response, and determining a winner of a tournament based on the score.

20 Claims, 18 Drawing Sheets

U.S. PATENT DOCUMENTS

| | | | | | |
|---|---|---|---|---|---|
| 4,437,664 | A | | 3/1984 | Wiczer et al. | 273/121 A |
| 4,487,414 | A | | 12/1984 | Karkkainen et al. | 273/371 |
| 4,669,731 | A | | 6/1987 | Clarke | 273/143 R |
| 4,836,546 | A | | 6/1989 | DiRe et al. | 273/138 A |
| 5,014,991 | A | | 5/1991 | Mirando et al. | 273/138 A |
| 5,090,699 | A | | 2/1992 | Friedman | 273/126 R |
| 5,104,129 | A | | 4/1992 | Hamalainen et al. | 273/371 |
| 5,121,919 | A | | 6/1992 | Martti | 273/121 B |
| 5,123,649 | A | | 6/1992 | Tiberio | 273/143 R |
| 5,131,655 | A | | 7/1992 | Ugawa | 273/121 B |
| 5,152,529 | A | | 10/1992 | Okada | 273/143 R |
| 5,342,049 | A | | 8/1994 | Wichinsky et al. | 273/119 R |
| 5,393,051 | A | | 2/1995 | Merino et al. | 273/29 B |
| 5,393,057 | A | | 2/1995 | Marnell, II | 273/85 CP |
| 5,560,603 | A | | 10/1996 | Seelig et al. | 463/6 |
| 5,580,309 | A | | 12/1996 | Piechowiak et al. | 463/16 |
| 5,630,586 | A | | 5/1997 | Lowden | 273/138.2 |
| 5,718,429 | A | * | 2/1998 | Keller, Jr. | 273/274 |
| 5,788,573 | A | | 8/1998 | Baerlocher et al. | 463/16 |
| 5,833,537 | A | | 11/1998 | Barrie | 463/21 |
| 6,193,606 | B1 | | 2/2001 | Walker et al. | 463/20 |
| 6,331,144 | B1 | | 12/2001 | Walker et al. | 463/20 |
| 6,413,160 | B1 | * | 7/2002 | Vancura | 463/16 |

OTHER PUBLICATIONS

Website: "SOFTSEEK COM—Trivia Games and Software", Trivia, (wysiwyg //29http //wwwsoftseek com/Games/Trivia/), download date: Sep. 17, 1999.

Website: "Welcome to WinSite", Casino Winsite: Slot Machine Games, (http //www winsite com/casino/slots/), download date: Sep. 17, 1999.

Website: "Win95 Games: Cards & Gambling", (http //www aclass com/SOFT/gamesc html), download date: Sep. 17, 1999.

"Slots of Trivia v1.3 'Payoffs' Help Documentation", (http://www.softsite.com), Ultimate Software, Download date: Feb. 2000.

Slots of Trivia v1.3 "Game Mode" Help Documentation, (http://www.softsite.com), Ultimate Software, Download date: Feb. 2000.

* cited by examiner

| SYMBOLS | REELS | | |
|---|---|---|---|
| | REEL NUMBER ONE | REEL NUMBER TWO | REEL NUMBER THREE |
| CHERRIES | 2 | 5 | 2 |
| ORANGES | 2 | 3 | 7 |
| PLUMS | 5 | 1 | 10 |
| BELLS | 10 | 2 | 1 |
| BARS | 2 | 10 | 1 |
| 7S | 1 | 1 | 1 |

FIG. 4

500

| PLAYER TRACKING NUMBER 520 | NAME 525 | ADDRESS 530 | TELEPHONE NUMBER 535 | CREDIT CARD NUMBER 540 | CREDIT BALANCE 545 | TRIVIA CATAGORY PREFERENCE 550 | PLAYER SCORE 550 | PLAYER STATUS 550 |
|---|---|---|---|---|---|---|---|---|
| 4127 | BOB SMITH | XX ST. STAMFORD, CT | | | | SPORTS | | |
| 4128 | JM RED | YY ST. NY, NY | | | | TELEVISION | | |
| 4129 | JOE GREEN | ZZ ST. LAS VEGAS, NV | | | | BROADWAY MUSIC | | |

510 511 512

FIG. 5

600

| | QUESTION NUMBER 620 | CATEGORY 625 | DIFFICULTY LEVEL 630 | QUESTION 635 | POSSIBLE ANSWERS 640 | CORRECT ANSWER 645 | VALUE 650 |
|---|---|---|---|---|---|---|---|
| 605 | 1 | SPORTS (PRO HOCKEY) | 3 | IN WHAT CITY WERE THE FLAMES LOCATED BEFORE MOVING TO CALGARY? | ATLANTA, MILWAUKEE, TORONTO, DETROIT | ATLANTA | 10 |
| 610 | 3 | SPORTS (PRO HOCKEY) | 2 | WHICH CHICAGO BLACKHAWKS GOALIE HOLDS THE RECORD FOR VICTORIES IN A SINGLE SEASON? | ESPOSITO, BELFOUR, HACKETT, GIACOMIN | BELFOUR | ESPOSITO, 2; BELFOUR, 4; HACKETT, 1; GIACOMIN, 0 |
| 615 | 5 | SPORTS (PRO HOCKEY) | 1 | WHICH BOSTON BRUIN DEFENSEMAN BECAME THE FIRST PLAYER TO WIN TWO CONN SMYTHE AWARDS AS STANLEY CUP MVP? | COFFEY, BORQUE, ORR, WESLEY | ORR | COFFEY, 1; ORR, 5 |

FIG. 6

700

| | RANDOM NUMBER 740 | COMBINATION 750 | EXPECTED HITS PER CYCLE 760 |
|---|---|---|---|
| 702 | 1-8570 | NONWINNING COMBINATION | 8570 |
| 704 | 8571-9250 | CHERRY/ANY/ANY | 680 |
| 706 | 9251-9930 | ANY/ANY/CHERRY | 680 |
| 708 | 9931-10130 | CHERRY/CHERRY/ANY | 200 |
| 710 | 10131-10330 | ANY/CHERRY/CHERRY | 200 |
| 712 | 10331-10398 | CHERRY/ANY/CHERRY | 68 |
| 714 | 10399-10418 | CHERRY/CHERRY/CHERRY | 20 |
| 716 | 10419-10460 | BAR/ORANGE/ORANGE | 42 |
| 718 | 10461-10466 | ORANGE/ORANGE/BAR | 6 |
| 720 | 10467-10508 | ORANGE/ORANGE/ORANGE | 42 |
| 722 | 10509-10528 | BAR/PLUM/PLUM | 20 |
| 724 | 10529-10533 | PLUM/PLUM/BAR | 5 |
| 726 | 10534-10583 | PLUM/PLUM/PLUM | 50 |
| 728 | 10584-10587 | BAR/BELL/BELL | 4 |
| 730 | 10588-10607 | BELL/BELL/BAR | 20 |
| 732 | 10608-10627 | BELL/BELL/BELL | 20 |
| 734 | 10628-10647 | BAR/BAR/BAR | 20 |
| 736 | 10648 | 7/7/7 | 1 |

FIG. 7

800

| | RANDOM NUMBER 840 | COMBINATION 850 | EXPECTED HITS PER CYCLE 860 |
|---|---|---|---|
| 802 | 1-8520 | NONWINNING COMBINATION | 8520 |
| 804 | 8521-9250 | CHERRY/ANY/ANY | 730 |
| 806 | 9251-9930 | ANY/ANY/CHERRY | 680 |
| 808 | 9931-10130 | CHERRY/CHERRY/ANY | 200 |
| 810 | 10131-10330 | ANY/CHERRY/CHERRY | 200 |
| 812 | 10331-10398 | CHERRY/ANY/CHERRY | 68 |
| 814 | 10399-10418 | CHERRY/CHERRY/CHERRY | 20 |
| 816 | 10419-10460 | BAR/ORANGE/ORANGE | 42 |
| 818 | 10461-10466 | ORANGE/ORANGE/BAR | 6 |
| 820 | 10467-10508 | ORANGE/ORANGE/ORANGE | 42 |
| 822 | 10509-10528 | BAR/PLUM/PLUM | 20 |
| 824 | 10529-10533 | PLUM/PLUM/BAR | 5 |
| 826 | 10534-10583 | PLUM/PLUM/PLUM | 50 |
| 828 | 10584-10587 | BAR/BELL/BELL | 4 |
| 830 | 10588-10607 | BELL/BELL/BAR | 20 |
| 832 | 10608-10627 | BELL/BELL/BELL | 20 |
| 834 | 10628-10647 | BAR/BAR/BAR | 20 |
| 836 | 10648 | 7/7/7 | 1 |

FIG. 8

900

| | WINNING COMBINATION 940 | NUMBER OF COINS AWARDED | | |
|---|---|---|---|---|
| | | NO TRIVIA ANSWER 950 | CORRECT TRIVIA ANSWER 960 | INCORRECT TRIVIA ANSWER 970 |
| 902 | CHERRY/ANY/ANY | 2 | 3 | 1 |
| 904 | ANY/ANY/CHERRY | 2 | 3 | 1 |
| 906 | CHERRY/CHERRY/ANY | 5 | 7 | 4 |
| 908 | ANY/CHERRY/CHERRY | 5 | 7 | 4 |
| 910 | CHERRY/ANY/CHERRY | 5 | 7 | 4 |
| 912 | CHERRY/CHERRY/CHERRY | 20 | 25 | 17 |
| 914 | BAR/ORANGE/ORANGE | 10 | 13 | 8 |
| 916 | ORANGE/ORANGE/BAR | 10 | 13 | 8 |
| 918 | ORANGE/ORANGE/ORANGE | 20 | 25 | 17 |
| 920 | BAR/PLUM/PLUM | 14 | 18 | 12 |
| 922 | PLUM/PLUM/BAR | 14 | 18 | 12 |
| 924 | PLUM/PLUM/PLUM | 20 | 25 | 17 |
| 926 | BAR/BELL/BELL | 18 | 22 | 16 |
| 928 | BELL/BELL/BAR | 18 | 22 | 16 |
| 930 | BELL/BELL/BELL | 20 | 25 | 17 |
| 932 | BAR/BAR/BAR | 20 | 25 | 17 |
| 934 | 7/7/7 | 50 | 100 | 40 |

FIG. 9

1000

| | WINNING COMBINATION 940 | NUMBER OF COINS AWARDED | | |
|---|---|---|---|---|
| | | NO TRIVIA ANSWER 950 | CORRECT TRIVIA ANSWER 960 | INCORRECT TRIVIA ANSWER 970 |
| 902 | CHERRY/ANY/ANY | 2 | 4 | 1 |
| 904 | ANY/ANY/CHERRY | 2 | 4 | 1 |
| 906 | CHERRY/CHERRY/ANY | 5 | 8 | 4 |
| 908 | ANY/CHERRY/CHERRY | 5 | 8 | 4 |
| 910 | CHERRY/ANY/CHERRY | 5 | 8 | 4 |
| 912 | CHERRY/CHERRY/CHERRY | 20 | 27 | 17 |
| 914 | BAR/ORANGE/ORANGE | 10 | 15 | 8 |
| 916 | ORANGE/ORANGE/BAR | 10 | 15 | 8 |
| 918 | ORANGE/ORANGE/ORANGE | 20 | 27 | 17 |
| 920 | BAR/PLUM/PLUM | 14 | 20 | 12 |
| 922 | PLUM/PLUM/BAR | 14 | 20 | 12 |
| 924 | PLUM/PLUM/PLUM | 20 | 27 | 17 |
| 926 | BAR/BELL/BELL | 18 | 24 | 16 |
| 928 | BELL/BELL/BAR | 18 | 24 | 16 |
| 930 | BELL/BELL/BELL | 20 | 27 | 17 |
| 932 | BAR/BAR/BAR | 20 | 27 | 17 |
| 934 | 7/7/7 | 50 | 105 | 40 |

FIG. 10

ELECTRONIC GAMING DEVICE OFFERING A GAME OF KNOWLEDGE FOR ENHANCED PAYOUTS

CROSS-REFERENCE TO RELATED APPLICATIONS

The present application is a continuation-in-part of U.S. patent application No. 09/713,046 filed Nov. 15, 2000 which issued as U.S. Pat. No. 6,331,144 B1 on Dec. 18, 2001; which is a continuation of U.S. patent application No. 08/885,157 filed Jun. 30, 1997 and issued Feb. 27, 2001 as U.S. Pat. No. 6,193,606.

FIELD OF THE INVENTION

The present invention relates generally to a system for increasing the entertainment value and utilization of electronic gaming devices, such as slot machines, by providing players with an additional incentive for continued play, and more particularly, to a system for allowing players of such electronic gaming devices to play a game of knowledge, such as a trivia game, while playing the electronic gaming device.

BACKGROUND OF THE INVENTION

Slot machines, including video poker, video keno or video blackjack (hereinafter, collectively referred to as "slot machines" are an important source of income for the gambling industry. Accordingly, casinos constantly search for new gaming strategies and features to provide additional incentives for slot machine players to continue play and to distinguish their slot machines from competitors in the industry. For example, as an added incentive to play slot machines, many casinos offer "slot club" programs to reward slot machine players. Each player in a slot club is generally issued a player tracking card encoded with his identification number. The casino awards "player reward points" for the player as he plays slot machines in that casino. The "player reward points" can generally be redeemed for merchandise or services at the casino hotel.

SUMMARY OF THE INVENTION

One embodiment of the present invention provides for receiving an indication of a wager, displaying a set of spinning reels, receiving a response to a game of knowledge while the reels are spinning, determining a score based on the response, and determining a winner of a tournament based on the score.

BRIEF DESCRIPTION OF THE DRAWINGS

FIG. 4 shows an illustrative symbol allocation for each reel of the slot machine of FIG. 3A;

FIG. 5 illustrates a sample table from the player database of FIG. 2;

FIG. 6 illustrates a sample table from the question database of FIG. 2;

FIG. 7 illustrates a sample table from the probability database of FIG. 3A;

FIG. 8 illustrates a sample table from the enhanced probability database of FIG. 3A;

FIG. 9 illustrates a sample table from the payout database of FIG. 3A;

FIG. 10 illustrates a sample table from the enhanced payout database of FIG. 3A;

DETAILED DESCRIPTION

Figure 1:
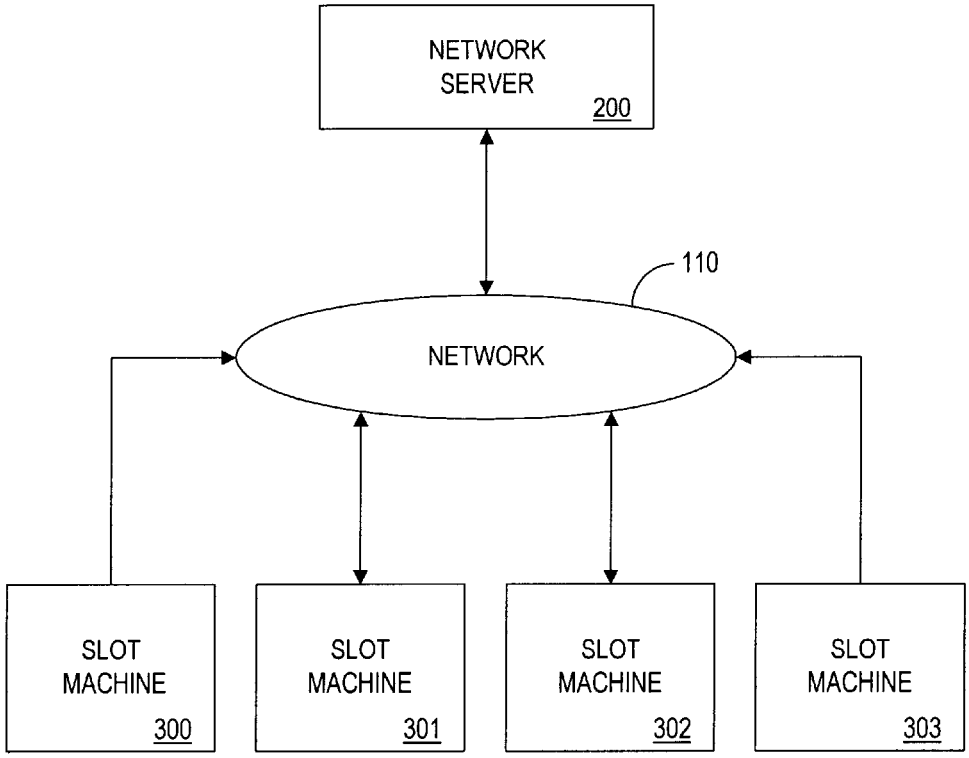
FIG. 1 is a schematic block diagram illustrating a suitable communications network for interconnecting one or more electronic gaming devices, such as slot machines, with a network server.

Generally, according to one embodiment of the invention, a player is permitted to play a game of knowledge, such as a trivia game, while playing a slot machine or other electronic gaming device. The player may be allowed to answer trivia questions while playing the slot machine on a complimentary basis, primarily for entertainment purposes, as an incentive for continued play, to increase prizes for slot play when trivia questions are answered correctly, by modifying the payout table to fund the trivia questions, and/or in exchange for an additional payment. The term "slot machine" refers to any programmable gaming terminal controlled by a random or pseudo-random event in which one or more players can wager on the outcome of the event, including traditional slot machines, video bingo, video keno, video poker and video blackjack devices.

According to various embodiments of the invention, the player can use successful trivia game results to access higher reward levels with the slot machine. The present invention provides a plurality of reward levels, with each reward level having progressively higher payouts for a given winning combination or a higher probability of a winning result or both. In one illustrative embodiment, a player reaches a higher reward level by exceeding a predefined threshold for consecutive correct answers, with the higher reward level resulting in increased payouts. In alternate embodiments, higher reward levels can be reached by exceeding any number of metrics, including predefined thresholds for consecutive correct answers in a predefined time period, predefined thresholds for correct answers in a predefined period of time, or predefined thresholds for the ratio of correct answers to incorrect answers within a predefined period of time. Thus, these and other embodiments of the present invention provide an interactive aspect which provides the player with an opportunity to affect the resulting reel combination or the associated payout. Further, various embodiments of the present invention may entertain the player while the reels of the slot machine are spinning, thus encouraging the player to continue playing.

The slot machine preferably includes a first probability database which stores the probability that each possible reel combination will result for a basic reward level and a first payout database which stores the payout associated with each winning reel combination, as well as the player's answer to the trivia question, for the basic reward level. As previously indicated, one feature of the invention allows a player to use successful trivia game results to access higher reward levels with the slot machine. Thus, an enhanced probability database preferably stores the probability that each possible reel combination will result for each higher reward level. In addition, an enhanced payout database preferably stores the payout associated with each winning reel combination, as well as the player's answer to the trivia question, for each higher reward level.

When play of the slot machine is initiated, the player is preferably given an opportunity to answer a trivia question while the reels are spinning. The outcome of the slot machine play and corresponding reel combination are determined by accessing the appropriate probability table, based on the current reward level. The appropriate payout is then located in the appropriate payout table, based on the identified slot game result, player's answer to the trivia question, and the current reward level.

In one preferred embodiment, the trivia questions are stored in a question database after being obtained from a remote source, in order to ensure an adequate supply of accurate and sufficiently challenging trivia questions. Thus, the slot machine may be connected to one or more remote content providers via a network server, for example, by means of the conventional telephone network or the Internet network.

With respect to various embodiments of the present invention, since many players are well versed in certain areas of trivia, the player can feel part of the gambling process and believe that his knowledge is increasing his odds of winning or results in higher payouts for a given winning combination. Furthermore, the present invention provides mental stimulation for a player during the "dead time" normally associated with the time the reels are spinning while the outcome is provided to the player. In this manner, embodiments of the present invention may attract new slot machine players and retain existing players of slot machines for longer periods of time.

FIG. 1 shows an illustrative network environment 110 for transferring information between one or more slot machines 300-303 and a network server 200. According to a feature of the present invention, each slot machine, such as slot machine 300, allows a player to play a trivia game, or another game of knowledge, while playing the slot machine 300. The player may be allowed to answer trivia questions while playing the slot machine 300 (a) on a complimentary basis, primarily for entertainment purposes, as an incentive for continued play, or (b) to increase prizes for slot play when trivia questions are answered correctly, by modifying the payout table to fund the trivia questions, or in exchange for an additional payment. According to a further feature of the invention, the player can use successful trivia game results to access higher reward levels with the slot machine 300, with each reward level having progressively higher payouts for a given winning combination or a higher probability of a winning result or both.

As used herein, the term "slot machine" refers to any programmable gaming terminal controlled by a random or pseudo-random event in which one or more players can wager on the outcome of the event, including traditional slot machines, video bingo, video keno, video poker and video blackjack devices. The network server 200 and the slot machine 300, discussed further below in conjunction with FIGS. 2 and 3A, respectively, may comprise conventional hardware and software, as modified herein to carry out the functions and operations described below. The network server 200 and slot machine 300 transmit digitally encoded data and other information between one another. The transmitted data and other information may represent a player name and identification number, play results, authenticated player identification, a menu of trivia categories and player selections, and the trivia questions and answer selections. The communications links between the network server 200 and each slot machine, such as slot machine 300, preferably comprise cable or wireless links on which electronic signals can propagate.

Figure 2:
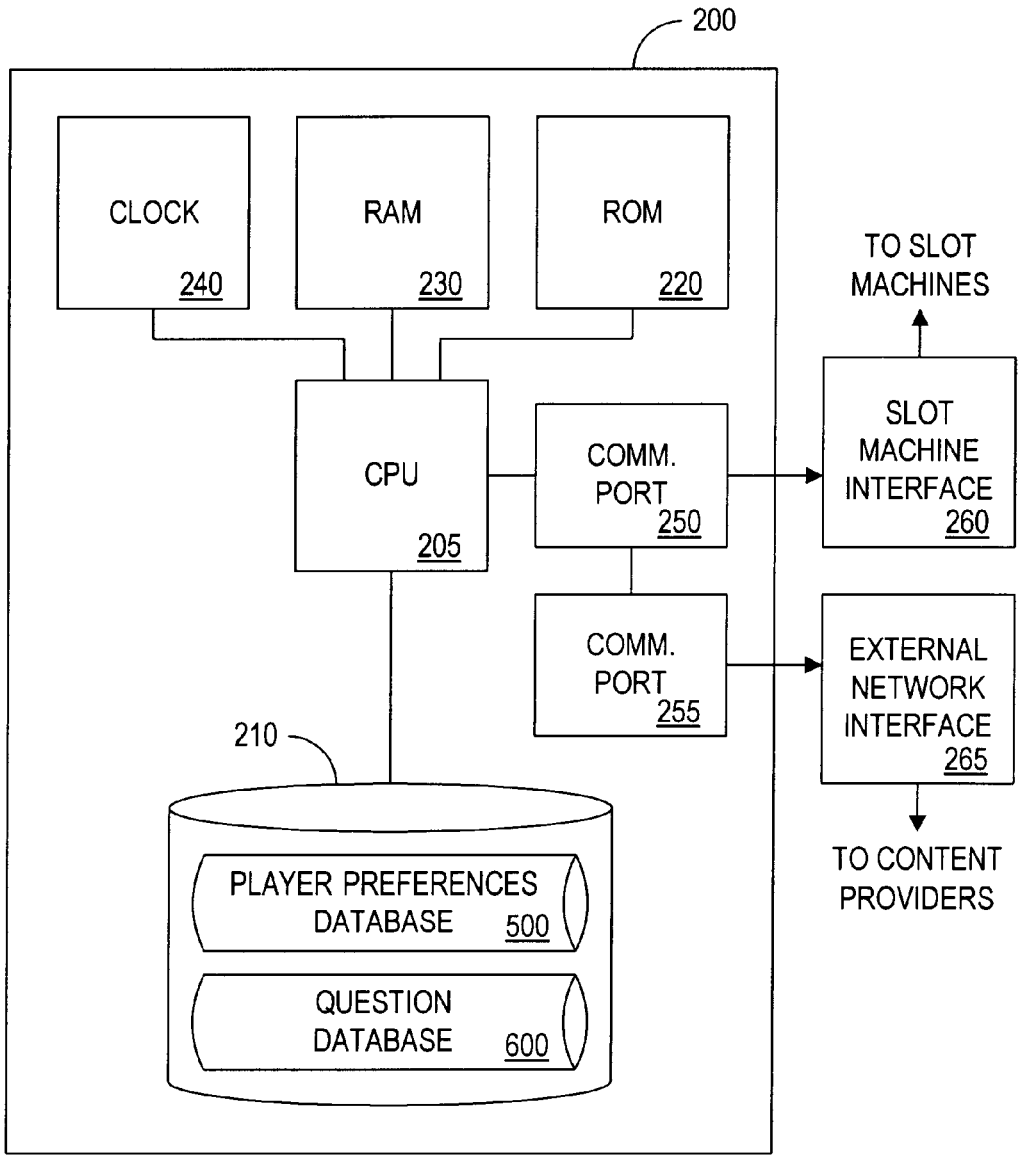
FIG. 2 is a schematic block diagram of the network server of FIG. 1.

FIG. 2 is a block diagram showing the architecture of an illustrative network server 200. The network server 200 may be embodied, for example, as an RS 6000 server, manufactured by IBM Corp., as modified herein to execute the functions and operations of the present invention. The network server 200 preferably includes certain standard hardware components, such as a central processing unit (CPU) 205, a data storage device 210, a read only memory (ROM) 220, a random access memory (RAM) 230, a clock 240, and communications ports 250 and 255. The CPU 205 is preferably linked to each of the other illustrated elements, either by means of a shared data bus, or dedicated connections, as shown in FIG. 2.

The CPU 205 may be embodied as a single processor, or a number of processors operating in parallel. The data storage device 210 and/or ROM 220 are operable to store one or more instructions, which the CPU 205 is operable to retrieve, interpret and execute, in accordance with an operating system (not shown). The CPU 205 preferably includes a control unit, an arithmetic logic unit (ALU), and a CPU local memory storage device, such as, for example, a stackable cache or a plurality of registers, in a known manner. The control unit is operable to retrieve instructions from the data storage device 210 or ROM 220. The ALU is operable to perform a plurality of operations needed to carry out instructions. The CPU local memory storage device is operable to provide high speed storage used for storing temporary results and control information.

As discussed further below in conjunction with FIGS. 5 and 6, the data storage device 210 includes a player database 500 and a question database 600. The player database 500 preferably stores information on each player, including an indication of the player's trivia game preferences. The question database 600 preferably stores the trivia questions and respective answers which are presented to each player.

The communications port 250 connects the network server 200 to a slot machine interface 260, thereby linking the network server 200 to each connected slot machine, such as the slot machines 300–303 shown in FIG. 1. The communications port 255 connects the network server 200 to an external network interface 265, thereby linking the network server 200 to one or more content providers via external networks. The communication ports 250 and 255 preferably include multiple communication channels for simultaneous connections.

In one preferred embodiment, the trivia questions stored in question database 600 are obtained from a remote source, in order to ensure an adequate supply of accurate and sufficiently challenging trivia questions. Thus, the external network interface 265 may connect the network server 200 to one or more remote content providers, for example, by means of the conventional telephone network or the Internet network. Such a remote source might be an Internet game site, or perhaps a corporation interested in generating trivia questions which might serve as a vehicle for the promotion of its products. A car manufacturer, for example, might provide trivia questions about general subjects but include a number of questions about models of cars that they sell. Alternatively, one website might serve as a collection point for trivia questions submitted by multiple manufacturers. The website may then transfer the questions to network server 200. The telephone network, as used herein, includes the combination of local and long distance wire or wireless facilities and switches known as the public switched telephone network ("PSTN"), as well as cellular network systems and the telephony feature of the Internet. The Internet network, as used herein, includes the World Wide Web (the "Web") and other systems for storing and retrieving information using the Internet.

It is noted that the functionality provided by the network server 200, such as providing each slot machine 300 with a source of trivia questions, could be provided directly by each slot machine 300 itself, as would be apparent to a person of ordinary skill. In this manner, a slot machine 300 could directly access a source of trivia questions, such as a desired content provider, via the telephone network or Internet, to obtain a supply of trivia questions.

Figure 3A:
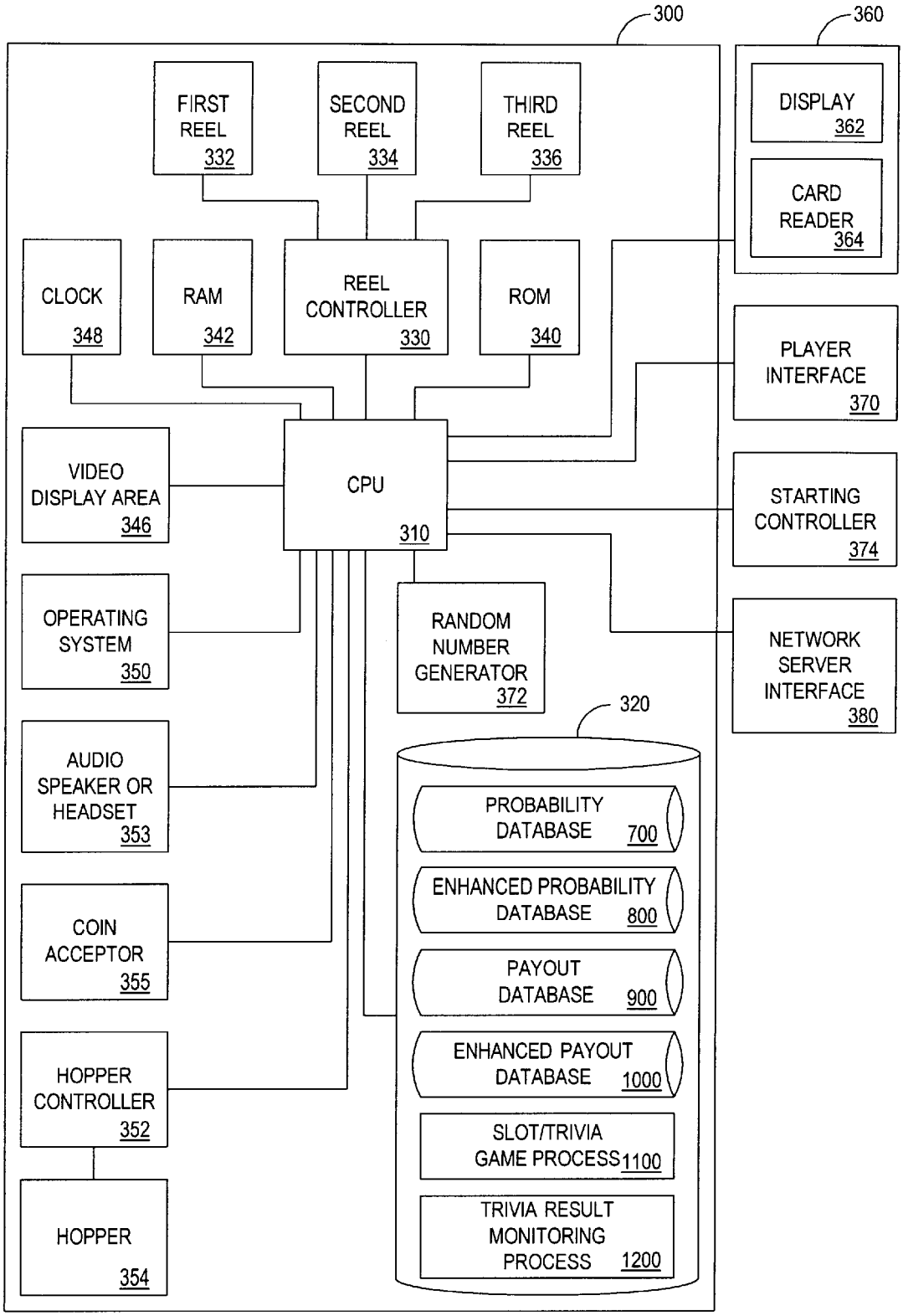
FIG. 3A is a schematic block diagram of a slot machine of FIG. 1.
Figure 3B:
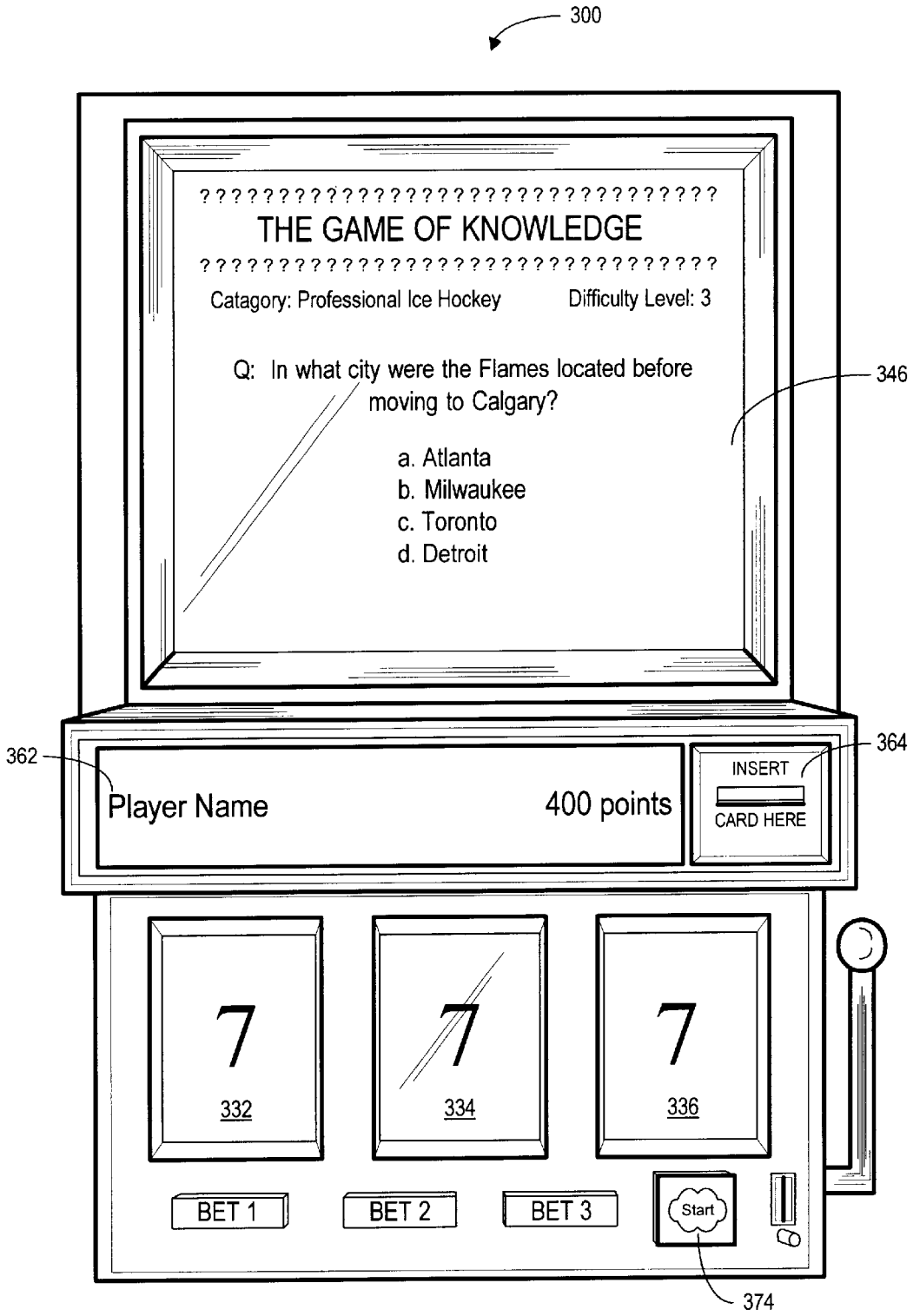
FIG. 3B is a perspective view of the slot machine of FIG. 3A.

FIG. 3A is a block diagram showing the architecture of an illustrative slot machine 300. A perspective view of the slot machine 300 is shown in FIG. 3B. The slot machine 300 preferably includes certain standard hardware components, such as a CPU 310, a data storage device 320, a ROM 340, a RAM 342, and a clock 348. The CPU 310 is preferably linked to each of the other illustrated elements, either by means of a shared data bus, or dedicated connections, as shown in FIG. 3A. The CPU 310 executes program modules stored in the data storage device 320 or the ROM 340 to perform the processes described below, in a known manner.

As discussed further below in conjunction with FIGS. 7 and 9, respectively, the data storage device 320 includes a probability database 700 and a payout database 900. The probability database 700 preferably stores the probability that each possible reel combination will result for a basic reward level, for an illustrative slot machine having three reels, each with twenty two symbols allocated in the manner shown in FIG. 4. The payout database 900 preferably stores the payout associated with each winning reel combination, as well as the correctness of the player's answer to the trivia question, for the basic reward level.

In addition, as previously indicated, one feature of the invention allows a player to use successful trivia game results to access higher reward levels with the slot machine 300 over the traditional basic reward level, with each reward level having progressively higher payouts for a given winning combination or a higher probability of a winning result or both. Thus, the data storage device 320 preferably also includes an enhanced probability database 800 or enhanced payout databases 1000, or a combination of the two, for each higher reward level. The enhanced probability database 800 preferably stores the probability that each possible reel combination will result for a higher reward level. The enhanced payout database 1000 preferably stores the payout associated with each winning reel combination, as well as the correctness of the player's answer to the trivia question, for a higher reward level.

In addition, as discussed further below in conjunction with FIGS. 11 and 12, respectively, the data storage device 320 preferably includes a slot/trivia game process 1100 and a trivia result monitoring process 1200. Generally, the slot/trivia game process 1100 initiates and coordinates the play of the slot machine 300 when a player initiates play. According to a feature of the present invention, in addition to conventional functions, the slot/trivia game process 1100 preferably presents the player with a trivia question to answer while the reels of the slot machine 300 are spinning. According to a further feature of the invention, the trivia result monitoring process 1200 preferably monitors the progress of a player's trivia game to determine when one or more casino-defined thresholds have been achieved by the player, to thereby permit the player to access higher reward levels with the slot machine 300.

As discussed further below in conjunction with FIG. 11, the player starts the slot machine 300 in a conventional manner by providing a form of payment, for example, by depositing one or more coins, or inserting a credit card, debit card or smart card, and pressing a starting controller 374, such as a "spin reels" button. Thereafter, the CPU 310, under control of the slot/trivia game process 1100, initiates the random number generator 372 to generate a number. The CPU 310 looks up the generated random number in the appropriate probability table 700, 800, discussed below in conjunction with FIGS. 7 and 8, respectively, based on the current reward level, and retrieves the corresponding reel combination, or game result. The CPU 310 also directs a reel controller 330 to spin the reels 332, 334, 336 and to stop them at a point when a combination of symbols corresponding to the retrieved combination is displayed. The player is preferably given an opportunity to answer a trivia question while the reels are spinning. Based on the identified slot outcome, as well as the player's answer to the trivia question, the CPU 310 locates the appropriate payout in one or more stored payout tables 900, 1000, based on the current reward level. When a payout is awarded, the slot machine 300 stores the credits in the random access memory (RAM) 342 and displays the available credits to the player in a video display area 346.

The trivia questions may be presented to a player at the slot machine 300 by means of the video display area 346, integrated with the slot machine 300, as shown in FIG. 3B. The player interface 370 preferably includes a mechanism for receiving an answer to the trivia question from the player. It is noted that the trivia questions may include multimedia information. Thus, in addition to the video display area 346, the slot machine 300 preferably includes an audio speaker or headset 353, for presenting such multimedia information to a player. In an alternate embodiment, the trivia questions may be presented to a player by means of a modular display unit which may be removed from the slot machine 300, such as a hand-held device (e.g., cell phone, personal digital assistant (PDA), pager), or by means of a set-top device. For example, the modular device could be a separate display screen, a stand alone device similar to a cable box, etc. One benefit of such a modular device is that the casino could implement the present invention without any change to the existing slot machine hardware.

In another embodiment, trivia questions are displayed on the reels of slot machine 300. If the reels are electronic, a portion of the space devoted to displaying the reels can display a question as the reels are spinning. For example, on a five-reel electronic game, each of the five reels could display 20% of the trivia question. Reels could also display hints, as described with reference to question database 600. In one embodiment, questions are displayed via display area 346, while hints are made available to the player via the electronic reels. In such an embodiment, each reel might have one stop (or multiple stops) which contained a hint symbol. By lining up the hint symbol on the payline, a hint is displayed to the player. In this embodiment, the player may be encouraged to play the machine at a faster pace in order to receive a hint before the time allotted for answering the trivia question expires.

A hopper controller 352 is connected to a hopper 354 for dispensing coins. When the player requests to cash out by pushing a button on the slot machine 300, the CPU 310 checks the RAM 342 to see if the player has any credit and, if so, signals the hopper 354 to release an appropriate number of coins into a payout tray (not shown). A coin acceptor 355 is connected directly to CPU 310. Coin acceptor 355 notifies CPU 310 of any coins deposited by the player.

A player tracking device 360 is also in communication with the CPU 310. The player tracking device 360 comprises a card reader 364 for reading player identification information stored on a player tracking card (not shown), which is preferably encoded with information to identify the player, in a known manner. The player tracking device 360 also preferably includes a display 362, having a touch screen, or associated player interface 370. Suitable commercially available player card tracking devices include, for example, the Mastercom device available from Bally Manufacturing. (See, for example, U.S. Pat. No. 5,429,361 to Raven et al.). Such player tracking devices include a magnetic card reader and a numeric keypad for entry of player information.

The slot machine 300 also includes a network server interface 380 that provides a communication path between the slot machine 300 and the network server 200. Thus, as discussed further below, information may be communicated among the player tracking device 360, slot machine 300 and network server 200.

In alternative embodiments, the slot machine 300 does not include the reel controller 330, or reels 332, 334, 336. Instead, the video display area 346 graphically displays representations of objects contained in the selected game, such as graphical reels or playing cards. These representations are preferably animated to display playing of the selected game.

FIG. 4 illustrates a suitable symbol-to-reel allocation for an illustrative twenty two-stop slot machine, such as the slot machine 300 shown in FIG. 3A. It is noted that for a slot machine having three reels, each with twenty two stops, there are a total of 10,648 reel combinations (22×22×22). The probability that any given reel combination will result is stored in one or more probability databases 700, 800, shown in FIGS. 7 and 8, respectively, and the corresponding payout for each reel combination is stored in one or more payout databases 900, 1000, shown in FIGS. 9 and 10, respectively. For a more detailed discussion of a suitable slot machine 300, and the associated probabilities and payouts, see J. Regan, Winning at Slot Machines (Citadel Press 1985), incorporated by reference herein.

As previously indicated, according to various embodiments of the present invention, the player database 500, shown in FIG. 5, preferably stores information on each player. The player database 500 preferably maintains a plurality of records, such as records 510–512, each associated with a different player. For each player identified by player tracking number in field 520, the player database 500 preferably includes fields for: name 525; address 530; telephone number 535; credit card number 540; credit balance 545; an indication of the player's trivia game preferences 550 with respect to trivia games (such as categories of trivia questions, difficulty level of trivia questions, or maximum or minimum values of questions); player score 555 (such as the number of correctly answered questions, the number of questions answered correctly in a row, or a score based on the value of questions answered correctly and/or incorrectly); and player status 560 (such as a ranking, an amount of complimentaries points ("comp points", an indication of participation in (or eligibility for) a tournament, an indication of the player's rate of play, and/or indication of eligibility for enhanced payout). In this manner, players can be automatically presented with trivia questions that are tailored to the indicated preferences of the particular player. It is to be understood that not all of these information fields, nor the depicted design of the player database 500, are necessary for each of the various embodiments of the present invention. Additional player information may also be included. Further, the examples of information provided herein are not exclusive; for instance, various embodiments of the present invention may include information about several different types of scores.

The question database 600, shown in FIG. 6, preferably stores the collection of trivia questions and respective answers which are presented to each player. As previously indicated, the trivia questions are preferably periodically obtained from a remote source, such as a web site, to ensure an adequate supply of accurate and sufficiently challenging trivia questions. In a preferred embodiment, the question database 600 stores a sufficient supply of questions to ensure that the same player is not presented with the same question twice. In addition, players in close physical proximity to one another in a casino should also not be presented with the same questions. The question database 600 maintains a plurality of records, such as records 605–615, each associated with a different question. For each question identified by question number in field 620, the question database 600 includes the category and difficulty level associated with the question in fields 625 and 630, respectively. In this manner, upon initiating play, the player can be queried for desired trivia categories and difficulty levels. In addition, the question database 600 preferably includes the text of each question, possible answers and the correct answer in fields 635, 640 and 645, respectively.

Question database 600 could also include a field for player hints, with each question having a corresponding short text hint. In one embodiment, a cost field is also included to allow the casino to charge a nominal sum for the hints. Alternatively, the player could earn a given number of hints per hour of play, per a particular amount wagered, or per a given number of handle pulls. A player could store a credit balance of earned hints for later use. In yet another embodiment, the cost of hints is offset by the player answering survey questions while at the slot machine. Hints could include an indication of one answer which is wrong, information which leads the player to the correct answer, information which narrows the possible range of an open ended question, etc.

Question database 600 could also include a field 650 for a value of the question. For example, each question could have a value that is based on its category, its difficulty, an amount wagered, and/or the frequency with which it is answered correctly. Other criteria may be used in determining the value of a question. Of course, all questions may be assigned the same value. A player may establish a preference for questions having a particular value or range of values. During play, a player may be given a choice of questions having different values, with correspondingly different payouts if answered correctly. A player may thus increase his score more quickly by selecting questions having a higher value. Alternatively, more than one possible answer could have a representative value in field 650. The player could then be awarded the value in field 650 that corresponds to the answer provided by the player.

As previously indicated, the probability database 700, shown in FIG. 7, preferably stores the probability that each possible reel combination will result for a basic reward level, for the illustrative slot machine having three reels, each with twenty two symbols allocated in the manner shown in FIG. 4. Thus, as shown in FIG. 7, 8,570 combinations out of a possible 10,648 reel combinations result in a non-winning result. In one embodiment, discussed below, the random number generator 372 generates a random number between 1 and 10,648 and then accesses the probability database 700 to retrieve the corresponding reel combination.

The probability database 700 maintains a plurality of records, such as records 702–736, each associated with a different possible reel combination. For each reel combination identified in field 750, the probability database 700 includes the corresponding random numbers which lead to that reel combination in field 740, and the number of times, on average, that the reel combination will result for each 10,648-play cycle of the slot machine 300 in field 760. For example, the reel combination "orange/orange/orange", shown in record 720 of the probability database 700, will be theoretically expected 42 times for each 10,648-play cycle of the illustrative slot machine 300. As shown in FIG. 4, in the illustrative embodiment, the symbol "orange" appears twice on reel number one, three times on reel number two, and seven times on reel number three. Thus, the probability that the combination "orange/orange/orange" will result is 42 (2×3×7) out of the total 10,648 possible reel combinations (22×22×22).

As previously indicated, one feature of the invention allows a player to use successful trivia game results to access higher reward levels for the slot machine 300, with each reward level having progressively higher payouts for a given winning combination or a higher probability of a winning result or both. Thus, an illustrative enhanced probability database 800, shown in FIG. 8, preferably stores the probability that each possible reel combination will result, for a higher reward level. The enhanced probability database 800, shown in FIG. 8, having fields 840, 850, 860, is virtually identical to the probability database 700, shown in FIG. 7, except for the increased probability of a winning result associated with the higher reward level. There are a number of ways to accomplish an increase in the probability of a winning combination. In the illustrative example shown in FIG. 8, the number of non-winning combinations has been reduced by approximately one-half percent (0.5%), or fifty expected hits per cycle, and those fifty hits per cycle have been transferred to the low-paying winning combination "cherry/any/any." Thus, when random numbers in the range 8521 through 8570 are generated, they will result in winning combinations for the higher reward level, as opposed to nonwinning combinations for the initial reward level. Thus, the player has a higher probability of a winning result and the casino can market the slot machine 300 as having more frequent payouts.

In an alternative embodiment, an increase in the probability of a winning combination is achieved by reallocating the illustrative symbol-to-reel allocation shown in FIG. 4 by substituting one or more symbols which are not very likely to result in winning combinations with symbols which are more likely to result in winning combinations. In a further alternate embodiment, an increase in the probability of a winning combination is achieved by providing a player with an opportunity to re-spin one or more reels for each of certain identified nonwinning combinations.

As previously indicated, the payout database 900, shown in FIG. 9, preferably stores the payout associated with each winning reel combination, as well as the correctness of the player's answer to the trivia question, for the basic reward level. The payout database 900 includes a plurality of records 902-934, each associated with a different reel combination. For each reel combination identified in field 940, the payout database 900 includes the corresponding number of coins awarded when the player provides no trivia answer, a correct trivia answer or an incorrect trivia answer, in fields 950 through 970, respectively. For example, if a player hits the reel combination "orange/orange/orange", shown in record 918, and provides a correct answer to a presented trivia question, the player will be awarded 25 coins for the illustrative one-coin wager model. In an alternate embodiment (not shown), the slot machine 300 can include additional fields in the payout database 900 for recording payouts associated with the numbers of coins wagered by the player, as would be apparent to a person of ordinary skill.

In addition, as previously indicated, one feature of the invention allows a player to use successful trivia game results to access higher reward levels with the slot machine 300, with each reward level having progressively higher payouts for a given winning combination or a higher probability of a winning result or both. Thus, an illustrative enhanced payout database 1000, shown in FIG. 10, preferably stores the payout associated with each winning reel combination, and trivia question result, as well as the correctness of the player's answer to the trivia question, for a higher reward level. The enhanced payout database 1000, shown in FIG. 10, is virtually identical to the payout database 900, shown in FIG. 9, respectively, except for the increased payouts for a given winning combination associated with the higher reward level.

As discussed further below in conjunction with FIGS. 11A through 11D, the processes performed by the slot machine 300, in the illustrative embodiment, require the slot machine 300 to interact with the network server 200. It will be understood by those of skill in the art that some or all of the processes described herein may be performed by the slot machine 300, the network server 200, or a combination thereof. Generally, the slot/trivia game process 1100 initiates and coordinates the play of the slot machine 300 when a player initiates play. According to a feature of the present invention, in addition to conventional functions, the slot/trivia game process 1100 preferably presents the player with a trivia question to answer while the reels of the slot machine 300 are spinning.

Figure 11A:
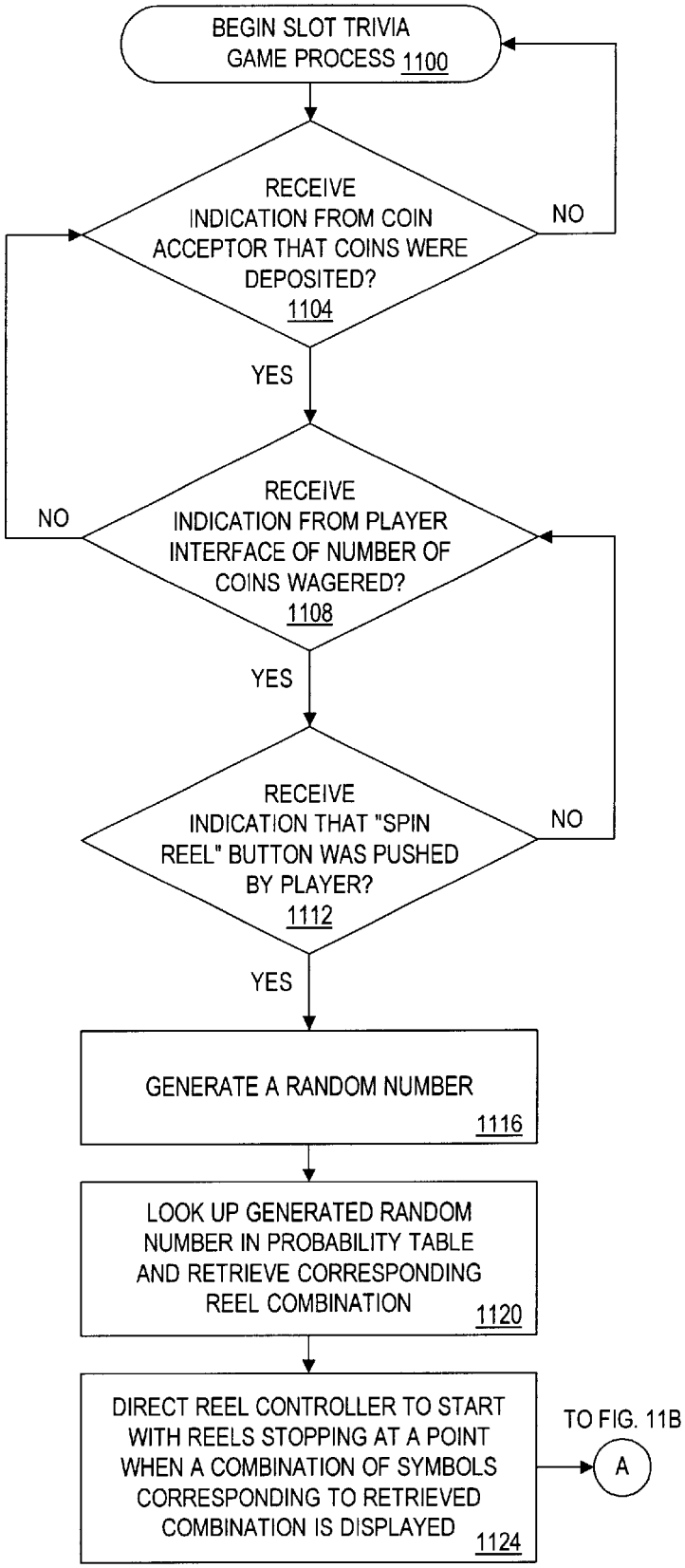
FIGS. 11A through 11D, collectively, are a flow chart describing an exemplary slot/trivia game process.
Figure 11B:
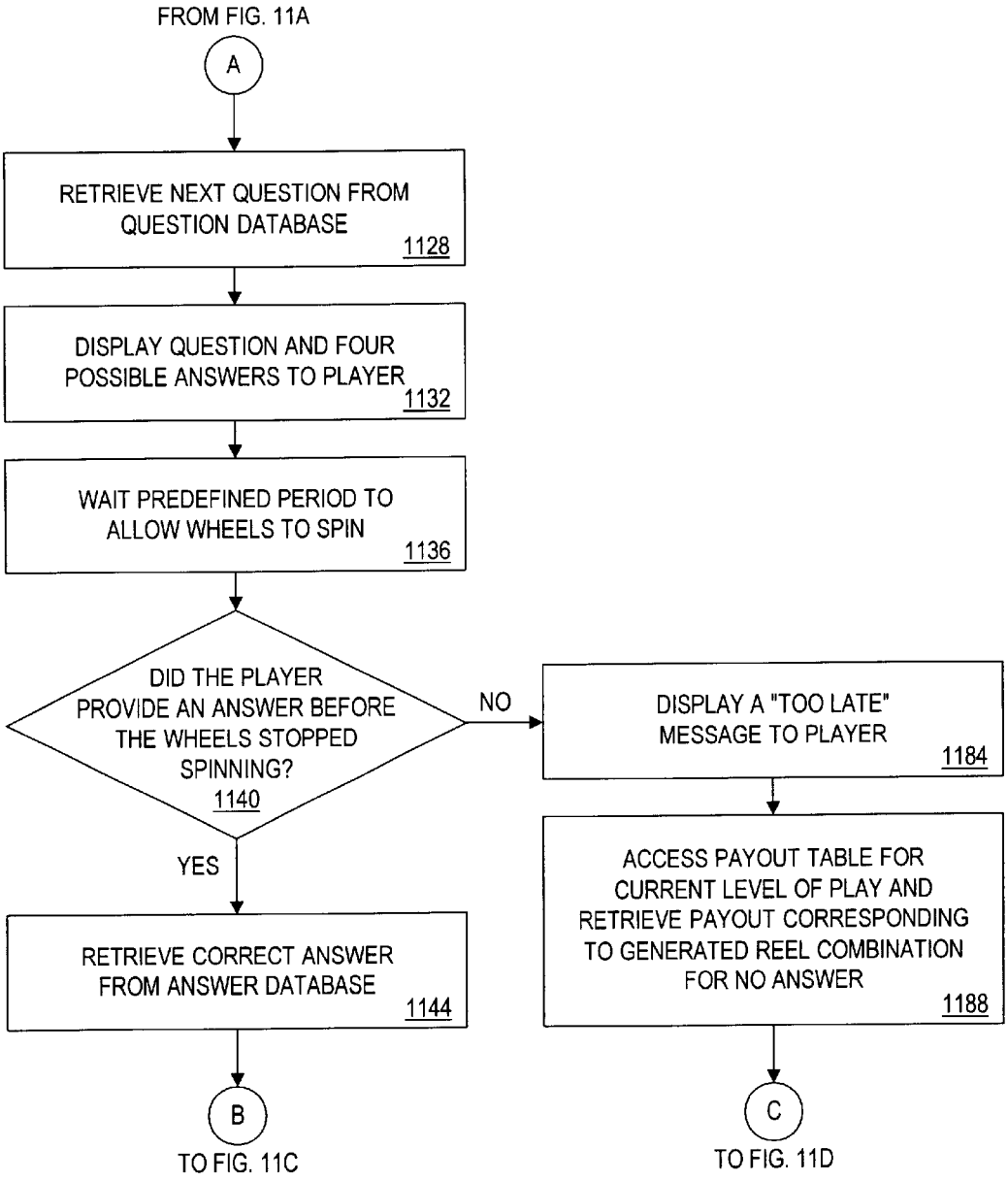
Figure 11C:
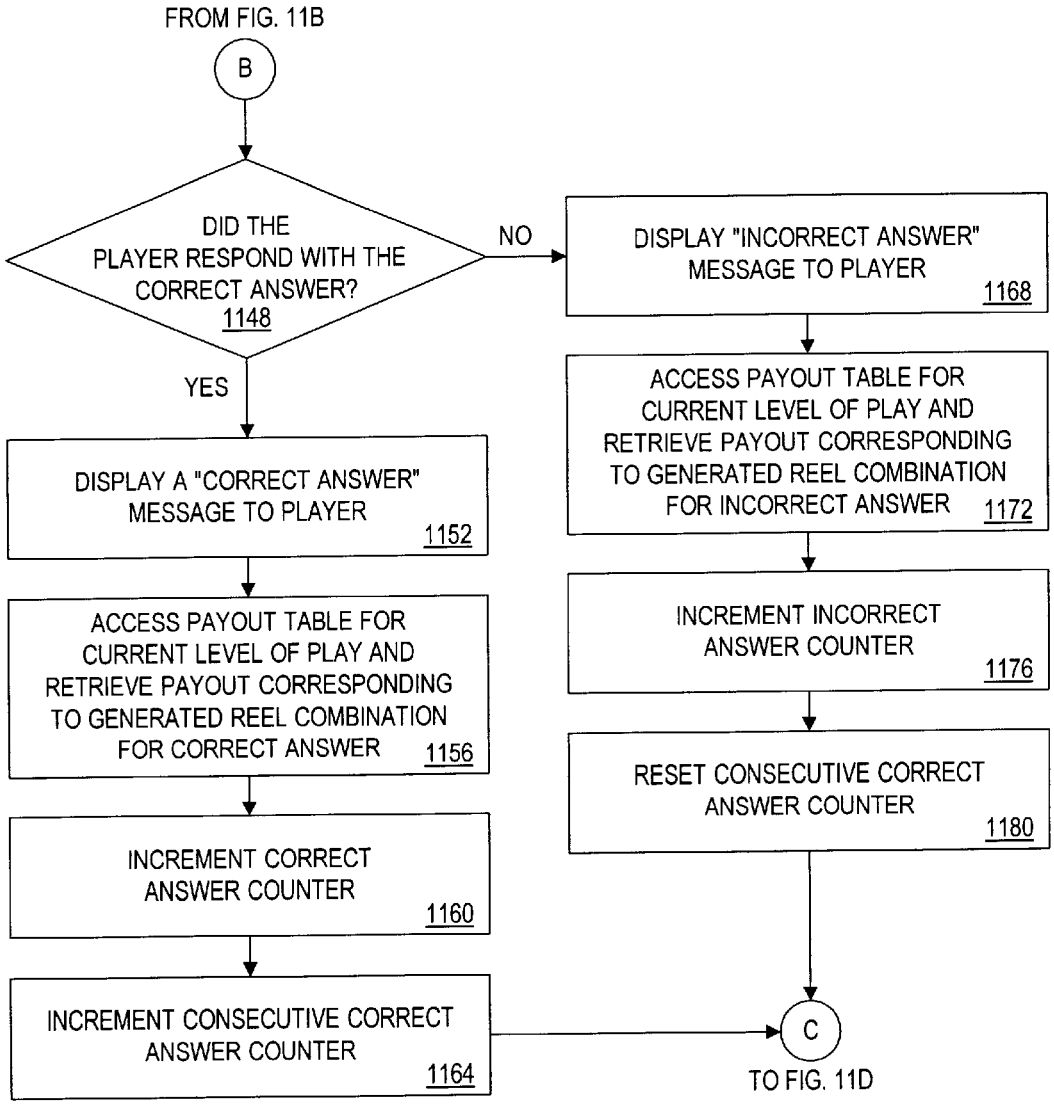
Figure 11D:
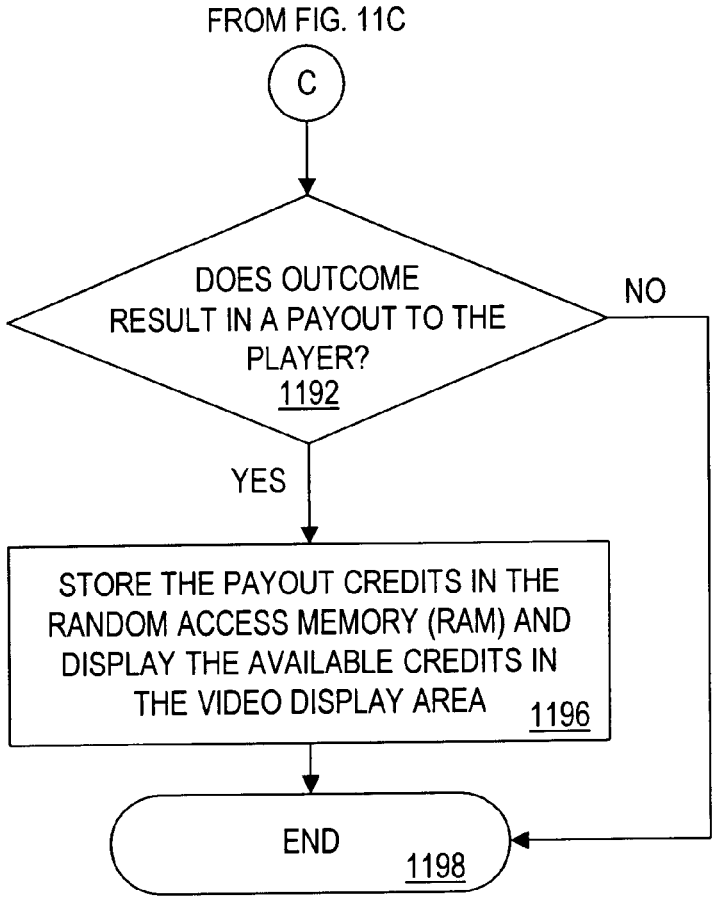

As illustrated in FIG. 11A, the slot machine 300 begins the processes embodying the principles of the present invention during step 1104, upon receipt of an indication from the coin acceptor 355, or another payment mechanism, that coins were deposited. A test is initially performed during step 1108 to determine if the CPU 310 has received an indication from the player interface 370 of the number of coins being wagered. If it is determined during step 1108 that the CPU 310 has received an indication of the number of coins being wagered, then program control continues to step 1112. If, however, it is determined during step 1108 that the CPU 310 has not received an indication of the number of coins being wagered, then program control returns to step 1108 to await such information.

A test is then performed during step 1112 to determine if the CPU 310 has received an indication that the player pressed the "spin reels" button. If it is determined during step 1112 that the CPU 310 has received an indication that the "spin reels" button was pressed by the player, then program control continues to step 1116. If, however, it is determined during step 1112 that the CPU 310 has not received an indication that the "spin reels" button was pressed by the player, then program control returns to step 1112 to await such information.

Thereafter, the slot/trivia game process 1100 generates a random number, during step 1116, and then looks up the generated random number in the appropriate probability table 700, 800, based on the current reward level, during step 1120, to retrieve the reel combination corresponding to the generated random number. The slot/trivia game process 1100 directs the reel controller 330 to start during step 1124, in a conventional manner, with the reels 332, 334, 336 stopping at a point when a combination of symbols corresponding to the combination retrieved during the previous step is achieved.

The next trivia question in the question database 600 is preferably retrieved during step 1128 (FIG. 11B), and then displayed, together with the four possible answers, to the player during step 1132. In the illustrative embodiment, the slot machine 300 retrieves a supply of questions periodically from the question database 600 stored by the network server 200. It is noted that the present invention is not limited to multiple choice questions, and questions need not be presented to a player for every reel spin. For example, trivia questions can be presented to a player only after certain predefined winning reel combinations are achieved. It is further noted that the same player is preferably not presented with the same question twice. In addition, players in close physical proximity to one another in a casino should also not be presented with the same questions. In order to ensure that the questions are presented to a given player in a random manner, the random number generated during step 1116 can be utilized to index the question database 600.

The slot/trivia game process 1100 waits a predefined period during step 1136 to allow the reels to stop spinning. A test is then performed during step 1140 to determine if the player provided an answer to the trivia question before the reels stopped spinning. In an alternate embodiment, the player could be allowed a predefined period after the reels stopped spinning to enter an answer. In a further alternate embodiment, the time it takes the player to answer the trivia question could determine how much the player wins, as would be apparent to a person of ordinary skill. For example, the player can have up to fifteen seconds to answer the question, but the reward or payout decreases as time passes.

If it is determined during step 1140 that the player provided an answer to the trivia question before the reels stopped spinning, then the correct answer is retrieved from the question database 600 during step 1144. Thereafter, a test is performed during step 1148 (FIG. 11C) to determine if the player responded with the correct answer. If it is determined during step 1148 that the player did respond with the correct answer, then a "correct answer" message is displayed to the player during step 1152.

The appropriate payout table 900, 1000 is accessed for the current reward level during step 1156 and the payout corresponding to the generated reel combination is retrieved for a correct trivia answer. Thereafter, a correct answer counter is incremented during step 1160 and a consecutive correct answer counter is incremented during step 1164. In this manner, the results of the trivia game can be monitored to determine when the player has reached casino-defined criteria for accessing the next level of slot machine play, as discussed further below in conjunction with FIG. 12.

If, however, it was determined during step 1148 that the player did not respond with the correct answer, then an "incorrect answer" message is displayed to the player during step 1168. The appropriate payout table 900, 1000 is accessed for the current reward level during step 1172 and the payout corresponding to the generated reel combination is retrieved for an incorrect trivia answer. Thereafter, an incorrect answer counter is incremented during step 1176 and the consecutive correct answer counter is reset during step 1180. Program control then proceeds to step 1192 (FIG. 11D), discussed below.

If it was determined during step 1140 (FIG. 11B) that the player did not provide an answer to the trivia question before the reels stopped spinning, then a "too late" message is displayed to the player during step 1184. The appropriate payout table 900, 1000 is accessed for the current reward level during step 1188 and the payout corresponding to the generated reel combination is retrieved for no trivia answer.

A test is then performed during step 1192 (FIG. 11D) to determine if the generated outcome resulted in a payout to the player, as previously determined by accessing the appropriate payout table 900, 1000. If it is determined during step 1192 that the generated outcome did not result in a payout to the player, then program control proceeds directly to step 1198. If, however, it is determined during step 1192 that the generated outcome resulted in a payout to the player, then the payout credits are preferably stored during step 1196 in the random access memory (RAM) 342, with the available credits preferably being displayed to the player in the video display area 346. Program control then preferably terminates during step 1198.

As previously indicated, one feature of the invention allows a player to use successful trivia game results to access higher reward levels with the slot machine 300, with each reward level having progressively higher payouts for a given winning combination or a higher probability of a winning result or both. Thus, the trivia result monitoring process 1200, shown in FIG. 12, preferably monitors the progress of a player's trivia game to determine when one or more casino-defined thresholds have been achieved by the player, to thereby permit the player to access higher reward levels within the slot machine 300. It is noted that the trivia result monitoring process 1200 can be executed continuously or at predefined intervals. In the illustrative embodiment shown in FIG. 12, a player reaches a higher reward level by exceeding a predefined threshold for the consecutive correct answer counter, with the higher reward level resulting in increased payouts. In alternative embodiments, higher reward levels can be reached by exceeding any number of metrics, including predefined thresholds for consecutive correct answers in a predefined time period, predefined thresholds for correct answers in a predefined period of time, or predefined thresholds for the ratio of correct answers to incorrect answers within a predefined period of time. In alternative embodiments, the value of each correctly-answered question could be determined, and the value could then be added to a running total of the values of all correctly-answered questions (e.g., a total score). Reward levels could then be reached by meeting a predefined threshold for the cumulative value of correctly-answered questions.

Figure 12:
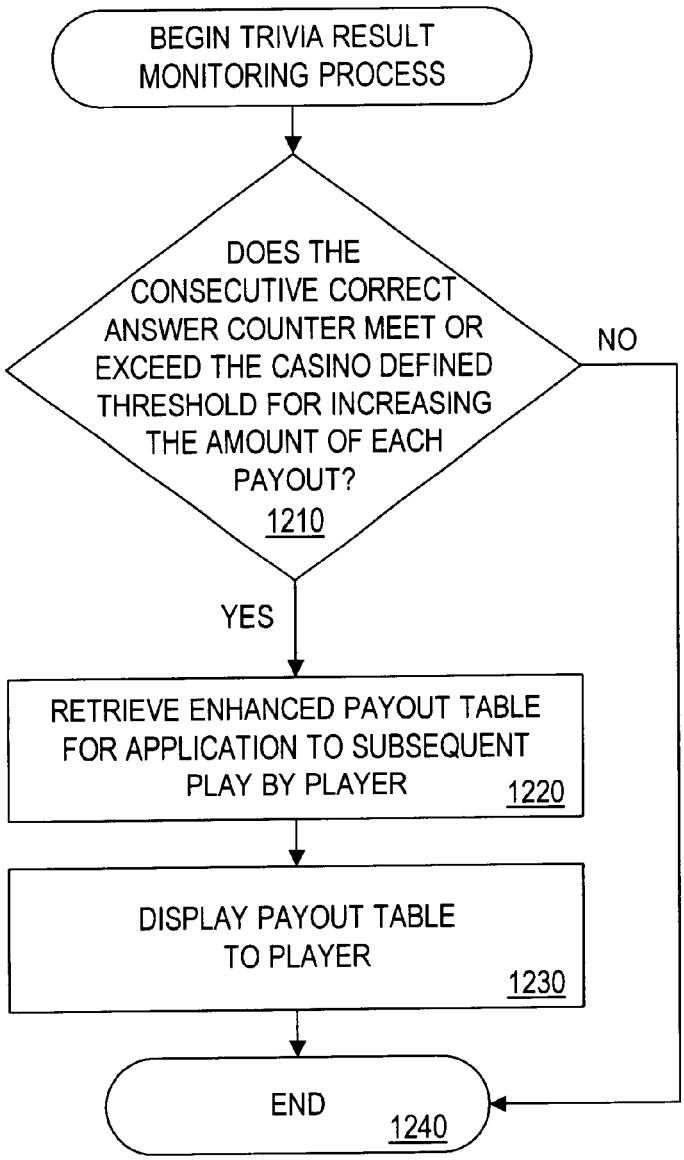
FIG. 12 is a flow chart describing a trivia result monitoring process.

Thus, as shown in FIG. 12, the trivia result monitoring process 1200 is entered during step 1210, where a test is performed to determine whether the current value of the consecutive correct answer counter meets or exceeds the casino-defined threshold for accessing the next reward level, having increased payouts. If it is determined during step 1210 that the current value of the consecutive correct answer counter does not meet or exceed the casino-defined threshold, then program control terminates during step 1240. If, however, it is determined during step 1210 that the current value of the consecutive correct answer counter meets or exceeds the casino-defined threshold, then the enhanced payout table 1000 is retrieved during step 1220 for application to the subsequent duration of play by the player. In a preferred embodiment, the enhanced payout table 1000 is displayed to the player during step 1230. Thereafter, program control terminates during step 1240.

In a preferred embodiment, the slot machine 300 includes a mechanism to ensure that only the player who has satisfied the casino-defined criteria for enhanced reward levels receives the higher payouts or higher probabilities associated with the higher reward levels. In other words, once the given player leaves the machine, the payout and probability levels preferably return to initial settings. For example, minimal security is achieved by requiring the player to insert a player tracking card for the duration of play. Greater security may be achieved, for example, using sensors to detect when a given player leaves a slot machine 300.

According to different embodiments, players may be ranked according to various casino-defined criteria. In one example, players may be ranked according to the number of questions they answer correctly during a given time period. The ranking may be displayed in the casino to foster competition among players (but need not be displayed).

In some embodiments of the present invention, questions or games have a binary right/wrong outcome (e.g., a player answers a question either correctly or incorrectly (not answering may be considered an incorrect answer), or the player either wins or loses). According to other embodiments, outcomes of questions (or games) could represent a range of values for each possible answer (or for the player's performance). For example, in a question-based game, there may be a correct (or most correct) answer to a question, but if the player provides a different answer, the player could still earn points. According to various embodiments, more than one possible answer could have a representative value 650. The player is awarded the value (or score) corresponding to the answer provided by the player, and the value may then be added to the player's total score 555. In another embodiment, a skill-based game allows for a range of potential scores, based on each player's performance and/or skill at the game.

In further variations of the invention, trivia tournaments can be established using the network server 200, as would be apparent to a person of ordinary skill. For example, prizes can be awarded to the first player to enter the correct answer or to the first player to answer a predefined number of questions correctly in a predefined period. In another example, prizes could be awarded to players for answering consecutive questions correctly. In another example, prizes may be awarded to the first player to earn a predefined score, or to the player having the highest score after a predefined period, where the player's score is based on the values of correctly-answered questions. For example, according to various embodiments, a player participating in a tournament would receive a score based on his response to a game of knowledge or game of skill. This score could then be added to a total score that represents how well the player is doing in the tournament. According to one embodiment, a player may have the option to select from questions having different values, or may establish a preference for questions having a particular value or having a value within a particular range of values. A player competing against other players in a tournament is thus able to increase his score more quickly by selecting questions having a higher value.

Figure 13:
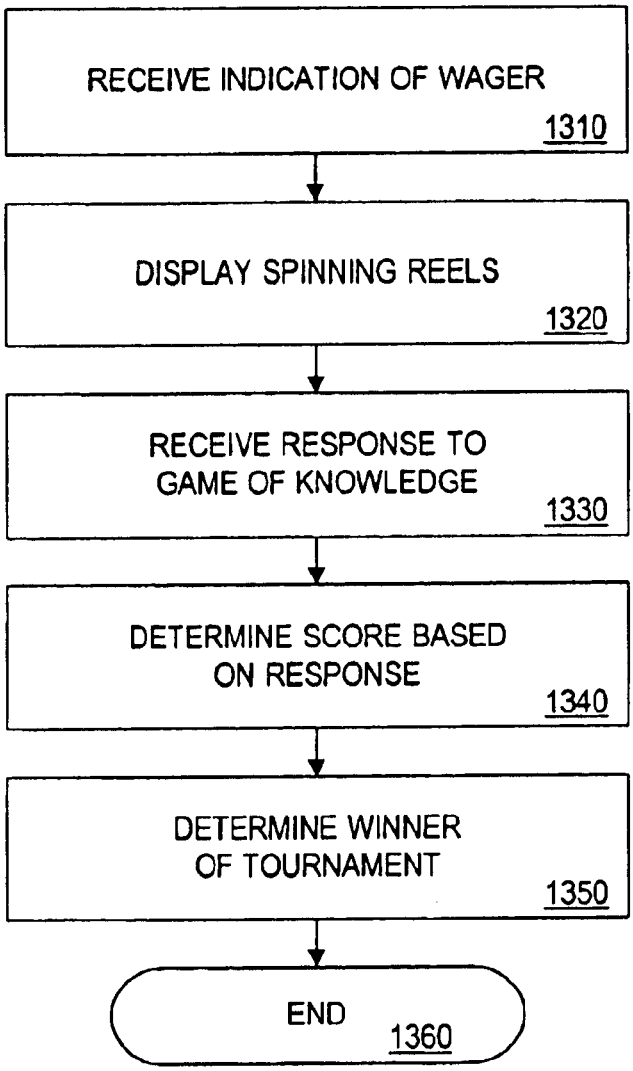
FIG. 13 is a flow chart of an exemplary tournament game process.

As illustrated in FIG. 13, an exemplary process 1300 in accordance with various embodiments of the present invention begins by receiving an indication of a wager during step 1310. For example, an indication may be received by the slot machine 300 or by network server 200 from the coin acceptor 355, or another payment mechanism, that coins were deposited. During step 1320, in a conventional manner, the spinning reels 332, 334, 336 are displayed. At step 1330, a response is received to a game of knowledge. A score is determined based on the response during step 1340. A winner of a tournament is determined at step 1350, according to the various embodiments described above, and the process ends at step 1360. It will be understood by those of skill in the art that steps or functionality described herein as being performed by the slot machine 300 may alternatively be performed by the network server 200.

Various tournament systems may be provided for by embodiments of the present invention. For example, tournament competition could involve a number of players, where each player (or team of players) competes against all of the other players (or teams). Alternatively, a tournament could involve Swiss-system play, in which a player competes against a single opponent in a first round, and then is matched with another opponent in the second round who achieved the same result in the first round. Some other alternative tournament structures include round robin style competitions (in which every player competes head-to-head with every other player) or elimination formats in which a player's first loss (or a predetermined number of losses) eliminates him from the competition. Tournament styles or systems not described herein may also be provided for by embodiments of the present invention.

Tournaments could be offered at no additional cost to the player, or could require the payment of an entry fee. Payment of the entry fee might require the player to deposit one of more coins into the coin acceptor 355 of slot machine 300, or could be deducted directly from the credit balance of the machine. In another embodiment, entry fees are awarded to the player along with the associated payouts for one or more outcomes. A player hitting "cherry/cherry/cherry," for example, might win a payout of fifteen coins and entry into the tournament, instead of the normal twenty coin payout. Alternatively, the player could be entered into the tournament based on one or more outcomes. For example, a player hitting "cherry/cherry/cherry" might win entry into the tournament in addition to the normal coin payout. Players could also use complimentaries points ("comp points" earned during slot machine play to pay for tournament entries. Casino slot hosts could of course also provide complimentary entry fees. Entry fees could also be free to any player who had achieved a goal determined by the casino, such as one thousand handle pulls that day, or one hundred handle pulls within a one hour period prior to the start of the tournament. Entry fees could also be free, but only for a limited number of players, on a first-to-sign-up basis. In one embodiment, the tournament is free to the one hundred players currently on the floor with the longest active play sessions (encouraging players to play for longer periods of time).

In an alternative embodiment, players may be entered in the tournament based on the response to a game of knowledge (or based on a performance in a game of skill). For example, players answering one or more questions correctly within a given time period may be entered. In another example, players answering a particular question (or questions) may be entered. In another example, players answering at least one question in each of a plurality of categories may be entered. In another example, a player answering a predetermined number of questions correctly (or a predetermined number of consecutive questions correctly) may be entered in a tournament. In an alternative embodiment, players obtaining a predetermined score may be eligible for the tournament. For example, players accumulating a score of one hundred points may be eligible. As described in detail herein, a player's score may be based on the value of the player's answers and/or a value of the question. According to various embodiments, requirements for entrance into the tournament may have to be met within a predetermined time limit, within a predetermined number of handle pulls, within a predetermined amount wagered, and/or within a predetermined number of questions given. Thus, these and various other embodiments of the present invention encourage players to play a slot machine game in order to gain entrance into a tournament.

In an alternative embodiment, players qualify for the tournament by achieving a predetermined rate of play. According to a further embodiment, players participating in a tournament are eligible to continue in the tournament as long as a predetermined rate of play is continued. For example, if a player's play drops below the required level during the tournament, the player might be ineligible to participate further and would receive a score based on his participation to that point. In some embodiments, such a player might be given the option to rejoin the tournament by bringing his rate of play back to a predetermined level. Alternatively, once a player is qualified for the tournament (e.g., by paying an entry fee, by achieving a predetermined rate of play), the player is eligible to continue in the tournament regardless of his rate of play. According to various embodiments of the present invention, if it is determined that a player qualifies for tournament play, then a response to a game of knowledge (or a performance in a game of skill) would count toward the player's tournament score.

Figure 14:
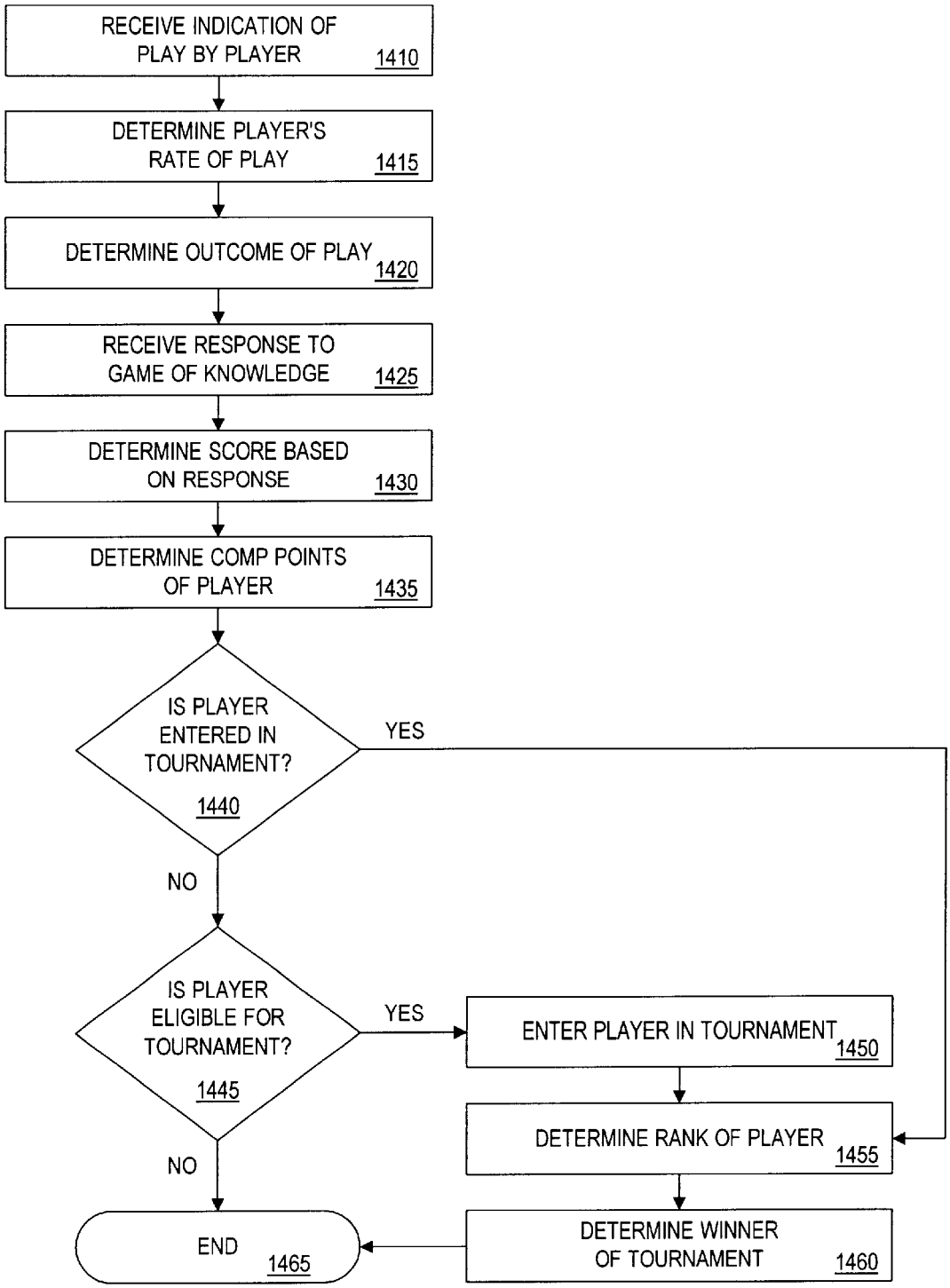
FIG. 14 is a flow chart of an exemplary tournament game process.

As illustrated in FIG. 14, an exemplary process 1400 for entering a player in a tournament in accordance with various embodiments of the present invention begins by the slot machine 300 (or network server 200) receiving an indication of a play by a player of a slot machine game at step 1410. For example, the player may start the slot machine 300 in a conventional manner by providing a form of payment, for example, by depositing one or more coins, or inserting a credit card, debit card or smart card, and/or by activating a starting controller 374, such as a "spin reels" button or pull handle. During step 1415, the player's rate of play is determined. For example, an indication of the player's rate of play may be contained in status field 560 and may be retrieved from player database 500. At step 1420, an outcome of the play is determined, either in a conventional manner or in accordance with various embodiments of the present invention directed to enhanced or modified payouts. At step 1425, the player's response to a game of knowledge is received. A score may be determined based on the response during step 1430. Further, any comp points associated with the player may be determined at step 1435. For example, an indication of the player's comp points may be stored in status field 560 and may be retrieved from player database 500.

At step 1440, it is determined if the player is entered in a tournament. For example, an indication of whether the player is entered in a tournament may be contained in status field 560 and may be retrieved from player database 500. If the player is not entered in a tournament, the process determines whether the player is eligible for a tournament at step 1445. As described with respect to various embodiments herein, for example, the player may be eligible for a tournament based on his rate of play, the outcome of the play, the response to the game of knowledge, the determined score, an earned entry fee, his comp points, and/or any further requirements or combinations of requirements determined by the casino. If it is decided that the player is eligible for a tournament, the player is entered into the tournament at step 1450, for example, by updating the status field 560 in player database 500. Alternatively, the player may be prompted with an invitation to enter the tournament. If the player is entered in the tournament, the process optionally may proceed to step 1455, where a rank of the player is determined. As described herein, for example, the rank of the player may be determined based on an accumulated total score for responses. A winner of a tournament may be determined at step 1460, in accordance with the various embodiments described herein. It will be understood by those of skill in the art that steps or functionality described herein as being performed by the slot machine 300 may alternatively be performed by the network server 200. Further, many of the steps described herein are for purposes of illustration, and need not be performed in entering a player in a tournament. For example, if a player's eligibility for a tournament is independent of his rate of play, step 1415 need not be performed.

Awards may be given to the player (or players) getting the most answers correct. Players would thus be encouraged to play faster in order to receive more questions. At least one question may be made available to the player for every handle pull, for every predetermined number of handle pulls, or at random. Alternatively, questions could be made available after a predetermined period of time (e.g., every five minutes), encouraging players to play longer. According to various embodiments, tournaments could be offered over a given time period (e.g., one-hour tournaments every hour on the hour) or for a given number of handle pulls (e.g., the player's answers to the questions corresponding to the next one hundred handle pulls count toward a player's tournament score). Alternatively, or in addition, tournaments could be conducted asynchronously (e.g., tournament players are required to answer one hundred questions sometime over a given time period, such as a day).

Tournaments could also be conducted as part of a secondary bonus game of slot machine 300. Instead of (or in addition to) earning prizes in the bonus round, a player's outcome(s) in a bonus game (or games) would be used to represent the player in a tournament competition against other players. According to one embodiment, a player would answer trivia questions or engage in a game of skill in a bonus game, as part of a tournament competition against other players. For example, during the bonus game, each player may have one minute to answer ten questions, and the player(s) achieving the best result(s) of the day could be awarded monetary prizes. According to another embodiment, correct answers from bonus games could also accumulate over time, with prizes being awarded to the player with the greatest number of correct answers over a particular time period.

While the tournament has been described as being played by players at slot machine 300, it should be noted that players in other areas of the casino might participate as well. Table game players, for example, might be provided with personal digital assistants capable of wireless communication with network server 200. Questions would be transmitted to the play and answers received from this device. Similar devices could allow casino customers at restaurants, shows, the pool, or even from hotel rooms to participate in tournaments.

Rather than having a single tournament for all players, a given tournament could be broken up into divisions such as beginner, intermediate, and advanced. Each of these groups might have its own entry fee structure, prize payouts, and rules. Each group could use different sets of tournament questions or the same set of tournament questions. Players could designate which group they wanted to play in before the tournament, or network server 200 could assign a group based on previous results for that player stored in player database 500. In one embodiment, any player winning a prize in a beginner division would be prevented from playing in that division a second time.

In another embodiment, rather than dividing a tournament by skill level, the tournament could be divided by the category of the questions. While each slot machine 300 might receive questions from all categories, a separate prize pool could be created for sports, entertainment, and science questions. The player with the highest score in each category would win the category prize. A tournament with ten categories of questions could offer prizes for the player with the best score total from his five best categories. In another embodiment, each slot machine 300 might receive questions for a particular category, allowing the player an opportunity to select a machine within his preferred category, or forcing the player to play multiple slot machines 300 in order to put together a better overall score.

In another embodiment, players form teams to answer questions. A four-person team, for example, might have any correct answer provided by a team member apply towards bonuses for all of the team members, much like a best ball golf competition. In another team embodiment, each member of the team gets to see the answers of other team members and can thus avoid answers already determined to be incorrect.

In yet another variation, slot machine 300 could have a progressive meter which awards the meter balance to the player correctly answering one or more trivia questions, perhaps in conjunction with the player hitting a particular outcome such as "bar/bar/bar". Multiple progressive meters could also be accommodated, with each meter having an associated trivia question. For example, before the player pulls the handle of slot machine 300, he picks one of the trivia questions. If his answer is correct, that particular progressive meter is active for the next one or more spins.

Because some players may be discouraged by getting too many questions wrong, slot machine 300 could offer consolation prizes for low accuracy rates. In one embodiment, any player answering at least thirty-five questions, but getting twenty or more wrong, would be eligible for a consolation prize, such as a ten minute phone card or a free three-month trial subscription to a weekly magazine. Such consolation prizes may have high perceived value to the player, while representing only a nominal cost to the casino.

Various embodiments of the present invention involve providing the answers to the player at slot machine 300 soon after the player provides an answer. Of course, the answers need not be provided at all. Alternatively, such answers (and/or the corresponding benefits) could be delayed for a period of time, or even provided only upon conclusion of the gaming session. For example, the player might answer fifty questions and then learn that he got forty-seven correct at the end of the gaming session, at which point slot machine 300 might provide a payout associated with the forty-seven correct answers. In another example, the session results could be directed to the set-top box associated with his room, so that the player could review the questions and answers in the comfort of his room. Question and answer summaries could likewise be transmitted to a handheld device that the player could take with him to a casino bar or restaurant for later review. In one embodiment, some (or all) player awards associated with correct answers are made available to the player only at designated locations within the casino, such as the casino cage, change booth, kiosk, gift shop, retail store, or restaurant.

For those players who do not seem to be participating in answering questions, slot machine 300 could periodically alter the subject category of the questions in the hope that a more appealing category is found for the player.

In yet another embodiment, trivia questions could be broadcast to all players simultaneously. This broadcast might be projected onto a wall (or walls) or ceiling of the casino, or could be displayed via slot machine 300. In this embodiment, every player receives the same question. In another embodiment, a random drawing may be held, with the winner of the drawing being qualified to answer the next trivia question. A correct answer could win the player a monetary payout or merchandise prize.

It is to be understood that the embodiments and variations shown and described herein are merely illustrative of the principles of this invention and that various modifications may be implemented by those skilled in the art without departing from the scope and spirit of the invention.

We claim:

1. A method comprising:

receiving an indication of a wager;

displaying a set of spinning reels;

receiving a response to a game of knowledge while the reels are spinning;

determining a score based on the response; and determining a winner of a tournament based on the score.

2. The method of claim 1, in which receiving the indication of the wager comprises:

receiving the indication of the wager at a slot machine.

3. The method of claim 1, in which receiving the response comprises:

receiving the response from a player.

4. The method of claim 3, further comprising:

entering the player in the tournament.

5. The method of claim 4, in which entering the player comprises:

entering the player in the tournament based on the response.

6. The method of claim 4, in which entering the player comprises:

entering the player in the tournament based on the score.

7. The method of claim 4, in which entering the player comprises:

determining an outcome of a play by the player of a slot machine game; and entering the player in the tournament based on the outcome.

8. The method of claim 4, in which entering the player comprises:

determining complimentaries points associated with the player; and entering the player in the tournament based on the complimentaries points.

9. The method of claim 1, further comprising:

determining a rate of play by a player; and determining whether the player qualifies for the tournament based on the rate of play, in which determining the winner comprises:

determining the winner of the tournament based on the score if the player qualifies for the tournament.

10. The method of claim 1, further comprising:

determining a rate of play; and determining whether the response is eligible for the tournament based on the rate of play, in which determining the winner comprises:

determining the winner of the tournament based on the score if the response is eligible for the tournament.

11. The method of claim 1, further comprising:

determining an outcome of a play by a player of a slot machine game; and determining whether the player qualifies for the tournament based on the outcome, in which determining the winner comprises:

determining the winner of the tournament based on the score if the player qualifies for the tournament.

12. The method of claim 1, further comprising:

determining a respective rank for each player of a plurality of players participating in the tournament.

13. The method of claim 12, further comprising:

displaying at least one respective rank.

14. A method comprising:

receiving an indication of a wager by a first player at a first slot machine;

displaying to the first player a set of spinning reels of a first slot machine game;

receiving an indication of a first response by the first player to a game of knowledge, the first response being made while the reels of the first slot machine are spinning;

determining a first score based on the first response;

determining at least one second score, each at least one second score corresponding to a respective second player; and determining a winner of a tournament based on the first score and the at least one second score.

15. The method of claim 14, further comprising:

determining a rate of play by the first player;

determining whether the first player qualifies for the tournament based on the rate of play; and entering the first player in the tournament if the first player qualifies for the tournament.

16. The method of claim 14, further comprising:

determining an outcome of the first slot machine game;

determining whether the first player qualifies for the tournament based on the outcome; and entering the first player in the tournament if the first player qualifies for the tournament.

17. The method of claim 14, further comprising:

determining complimentaries points associated with the first player;

determining whether the first player qualifies for the tournament based on the complimentaries points; and entering the first player in the tournament if the first player qualifies for the tournament.

18. The method of claim 14, further comprising:

determining a rank of the first player.

19. The method of claim 18, further comprising:

displaying the rank.

20. A method comprising:

receiving an indication of a wager by a first player at a first slot machine;

receiving an indication of a wager by a second player at a second slot machine;

displaying to the first player a set of spinning reels of a first slot machine game;

displaying to the second player a set of spinning reels of a second slot machine game;

receiving from the first player a first response to a first game of knowledge while the reels of the first slot machine are spinning;

receiving from the second player a second response to a second game of knowledge while the reels of the second slot machine are spinning;

determining a first score based on the first response;

determining a second score based on the second response; and determining a reward for the first player based on the first score and the second score.

* * * * *